US005613573A

United States Patent [19]

L'Hermine

[11] Patent Number: 5,613,573

[45] Date of Patent: Mar. 25, 1997

[54] SCAFFOLDING

[75] Inventor: Jean-Claude L'Hermine, Sautron, France

[73] Assignee: Etablissements Duarib, S.A., Saint-Philbert-De-Grand-Lieu, France

[21] Appl. No.: 302,798

[22] PCT Filed: Mar. 24, 1993

[86] PCT No.: PCT/FR93/00295

§ 371 Date: Sep. 15, 1994

§ 102(e) Date: Sep. 15, 1994

[87] PCT Pub. No.: WO93/20307

PCT Pub. Date: Oct. 14, 1993

[30] Foreign Application Priority Data

Mar. 30, 1992 [FR] France ..... 92 03798

[51] Int. Cl.$^6$ ..... E04G 3/02

[52] U.S. Cl. ..... 182/128; 182/179

[58] Field of Search ..... 182/128, 178, 182/179

[56] References Cited

U.S. PATENT DOCUMENTS

| | | | |
|---|---|---|---|
| 3,910,379 | 10/1975 | Miller | 182/128 |
| 4,057,943 | 11/1977 | Lienhard . | |

FOREIGN PATENT DOCUMENTS

| | | | |
|---|---|---|---|
| 2275256 | 1/1976 | France . | |
| 2290347 | 6/1976 | France . | |
| 2300875 | 9/1976 | France . | |
| 2384708 | 10/1978 | France . | |
| 3611431 | 10/1987 | Germany | 182/128 |
| 510572 | 2/1976 | U.S.S.R. | 182/128 |

*Primary Examiner*—Alvin C. Chin-Shue
*Attorney, Agent, or Firm*—Young & Thompson

[57] ABSTRACT

A scaffolding particularly designed for work inside large hollow elements (1) such as tanks, quarries, etc. The scaffolding comprises a supporting structure consisting of two struts (3) interconnected by at least two crossbars (4, 5) for forming the flooring and stiffening the whole scaffolding, modular platforms (6) projecting at varying heights from the outer surface of said struts (3), and members (7) providing access to said platforms and arranged in or near said struts (3). Said scaffolding may be used to lay insulators in methane tanks.

5 Claims, 5 Drawing Sheets

SCAFFOLDING

The present invention relates to scaffolding, more particularly adapted to be used within hollow elements of large dimensions such as tanks, quarries, et cetera. The scaffolding, according to the invention, is applicable more particularly to positioning insulating material within methane tanks.

Conventional scaffolding adapted to be used within hollow elements have generally a large number of members because they subdivide the hollow volume, which gives rise to high fabrication costs and long erection times at the same time hindering access and free movement behind the hollow element to be able to work there if necessary.

Such scaffolding is for example described in U.S. Pat. No. 4,057,943. In such scaffolding, a bearing member which is generally very heavy supports vertical and horizontal elements which subdivide the volume. As a result, the horizontal elements can come to bear against vertical elements. Only a small portion of the mounting assembly can if desired be mounted in cantilever fashion.

The object of the present invention is therefore to propose a modular scaffolding which permits a large number of manipulations with complete safety and repetitiveness while permitting benefitting from large regions for storage and the preparation of the materials before they are used, while taking up very limited space at the bottom of the element being worked on.

The invention thus relates to scaffolding particularly for working within hollow elements of large dimensions such as tanks, quarries, et cetera, characterized in that it comprises a load bearing structure formed of two struts interconnected by means of two cross pieces forming flooring and rigidifying the assembly, modular platforms mounted at variable heights in cantilever fashion on the external surface of said struts and means for access to said platforms disposed in or adjacent the struts.

According to a preferred embodiment of the invention, the modular platforms have at their end opposite that which is secured to the strut, a telescopic portion and struts of the load bearing structure are each provided with at least two lines of post feet disposed parallel to the longitudinal axis of the scaffolding, such post feet being adjustable in height so as to permit the temporary raising of at least one line of post feet per strut.

In this preferred embodiment of the invention, it is also possible, particularly in the case of use of the scaffolding for positioning insulation within tanks, to adapt perfectly the scaffolding to the shape of the wall in the case of monolayer or multilayer insulation and permitting, thanks to the raisable footings, to be able to work at the bottom of the tank, even in the presence of the scaffolding.

Other characteristics and advantages of the invention will become apparent from a reading of the description which follows and the accompanying drawing's, which description and drawings are given only by way of example. In these drawings.

Figure 1:
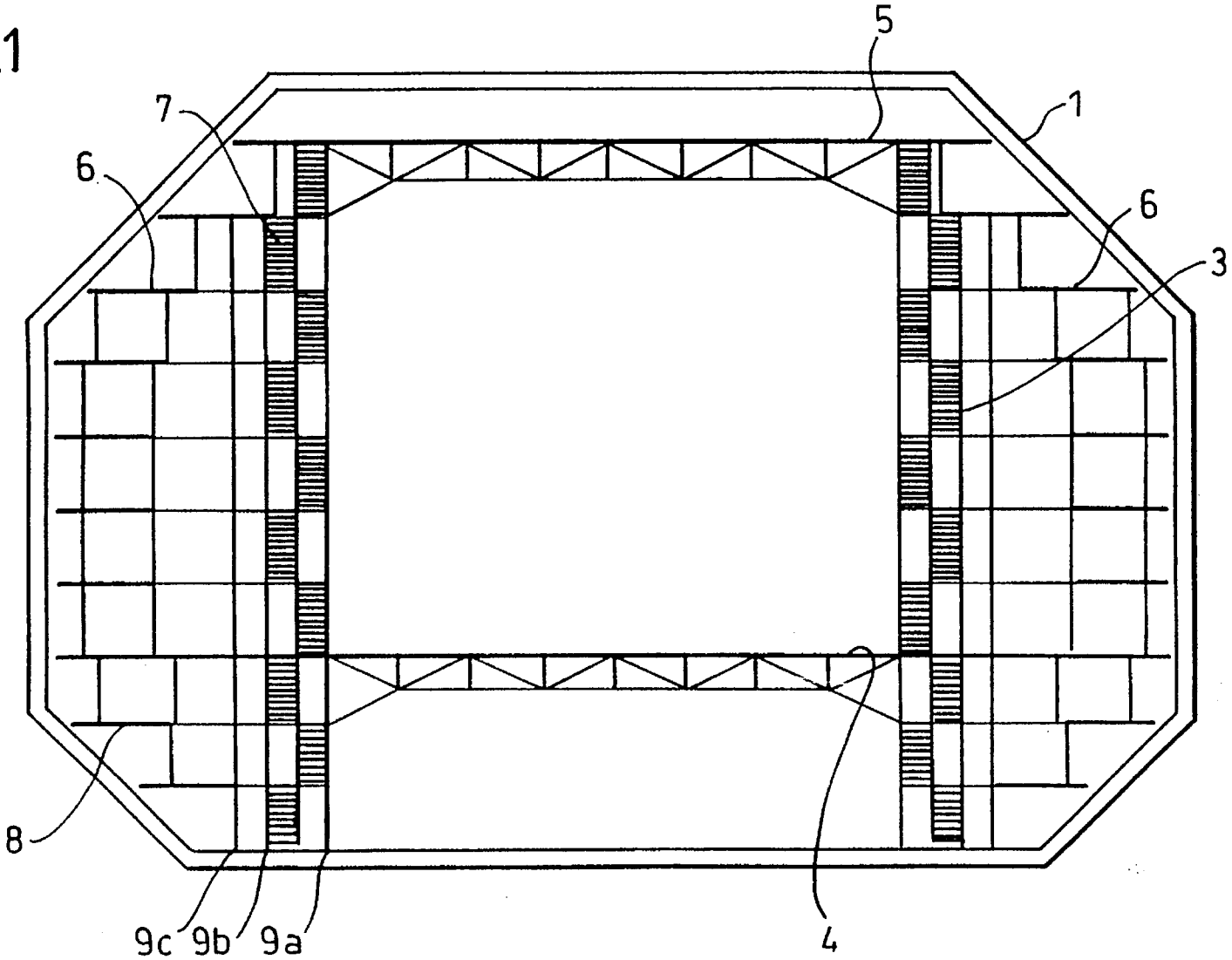
FIG. 1 is a cross sectional view of scaffolding according to an embodiment of the invention.

According to FIG. 1, the scaffolding according to the present invention comprises a load bearing structure formed of two struts or trusses 3, interconnected by at least two cross members 4, 5 forming flooring and rigidifying the assembly. The struts 3 are constituted of a metallic skeleton in the form of a network, so as to permit easy mounting and unmounting of the assembly, while permitting good access to the interior of the structure of the struts. The cross members themselves constitute flooring which permits placing in communication the struts 3 of the load bearing structure while defining regions for storage and preparation of materials. This flooring is generally used starting with beams constituted of modular elements which are assembled one by one so as to obtain, upon disassembly, elements of small dimensions. In the case of FIG. 1, the flooring occupies a higher position than the struts and an intermediate position. The upper flooring 5, which is located at the upper end of the struts 3, permits working on the ceiling of the tank as shown in FIG. 1, the intermediate flooring 4 serving only for storage of materials.

Figures 3A, 3B, 3C, 3D, 3E, 3F:
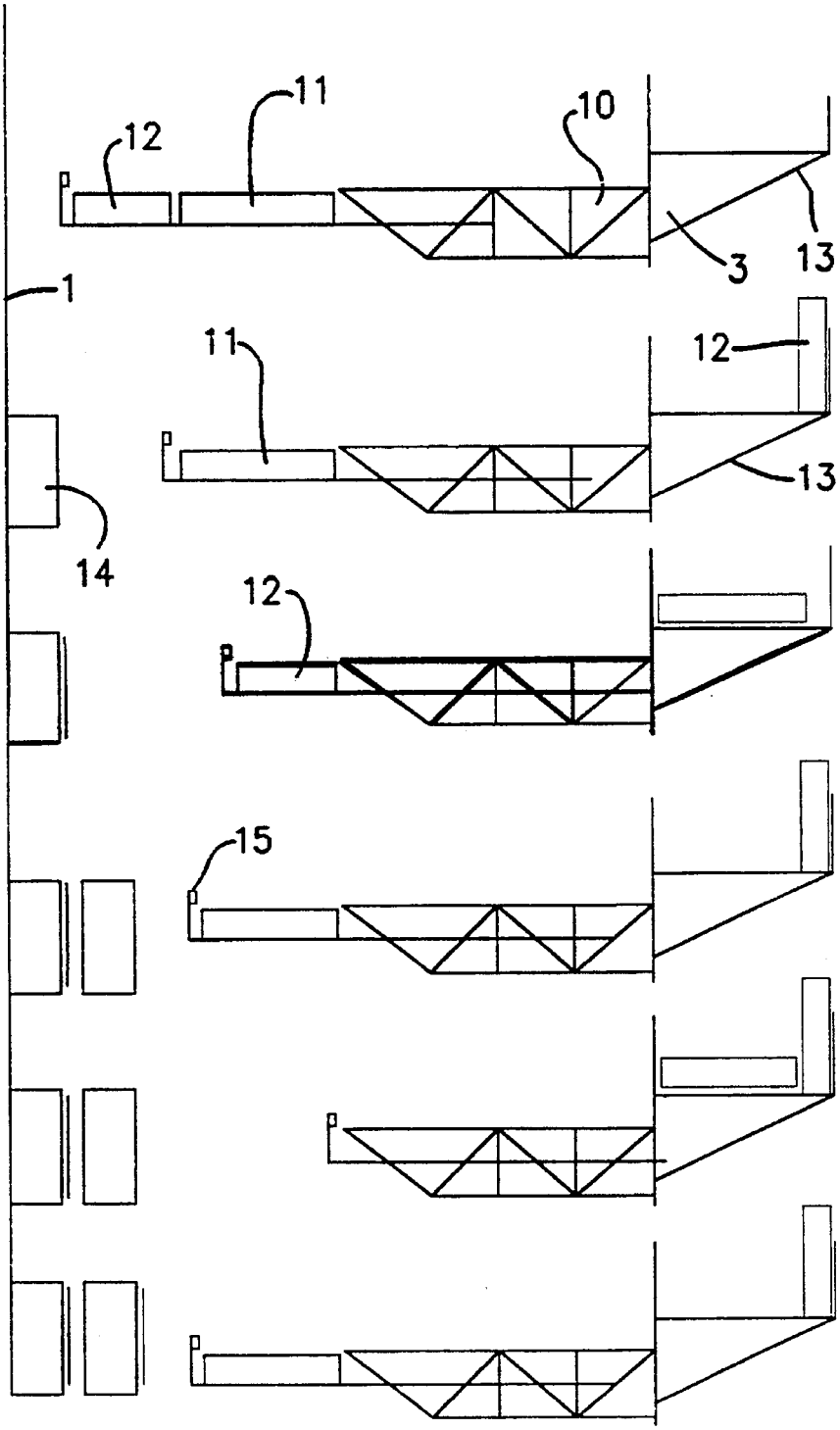
FIG. 3 shows a series of schematic views providing an example of the modularity of the flooring of the telescopic portions of the platforms of the scaffolding of FIGS. 1 and 2.
Figure 5:
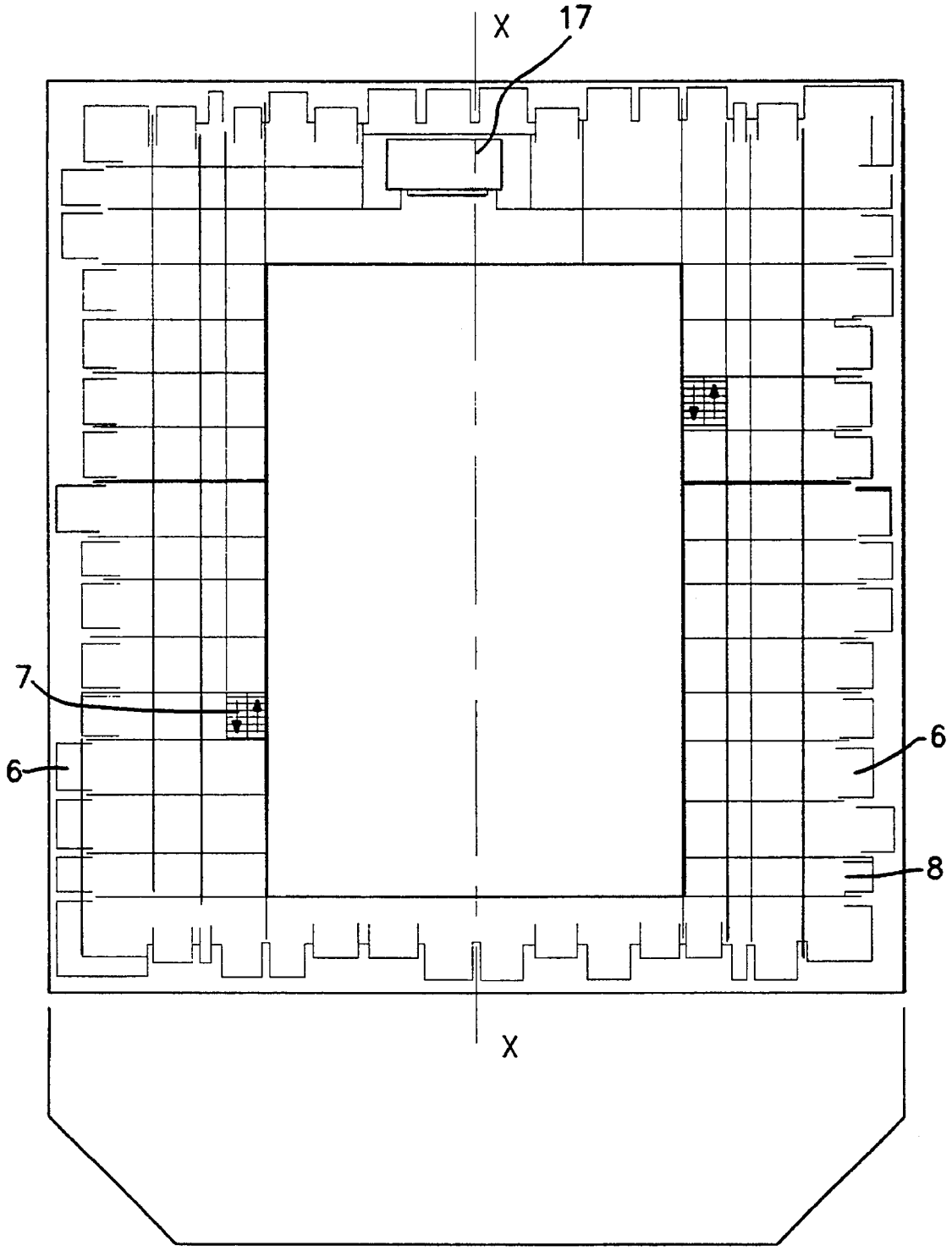
FIG. 5 is a view from above of a platform stage without flooring showing again the modularity of the flooring of the telescopic portions of the platforms of the scaffolding of FIGS. 1 and 2.

Within the struts 3 or adjacent these struts, there is provided access means to different levels of the struts. These access means can be constituted by staircases, designated by 7 in FIG. 1, and/or by lifts and/or elevators 17. These staircases 7 are preferably disposed diagonally opposite the level of the struts 3 in the hollow element such as a tank. Modular platforms 6 are mounted at variable heights in cantilever relation on the external surface of the struts 3 and permit users to have access to the sidewalls of the hollow element. These modular platforms are constituted of the removable flooring elements disposed side by side. It is thus possible to remove a flooring element without removing the contiguous element in the direction of the longitudinal axis XX and/or the transverse axis of the scaffolding or of the vessel. This characteristic is particularly interesting for the mounting and/or the dismounting of the assembly. This modularity of the platforms is moreover particularly important when the walls of the hollow element are not rectilinear, which is the case in the tank shown in FIG. 1. To be able to have access, at any level of the platforms, to the wall, no matter what the structure of this wall, it is necessary that the modular platforms 6 have at their end opposite that secured to the strut 3, a telescopic portion 8. This telescopic portion is shown in heavy line in FIGS. 1 and 5. Obviously, over all the length of the flooring in the direction of the longitudinal axis XX of the scaffolding, there will be disposed several telescopic devices so as to be able to actuate the constituent flooring elements of the platform independently of each other along a length of several tens of meters, as shown in FIG. 5. Similarly, the telescopic elements of the platforms disposed in the angles of the structure are mounted telescopically along two orthogonal axes as shown in FIG. 5 so as to render possible all the imaginable configurations. This telescopic portion can vary as a function of its use and thereby permit very different work operations at the level of the internal wall of the element 1. Thus, in FIG. 3, there is given an example of an embodiment of a telescopic portion of a platform which permits the installation of two different installations separated by a covering within the tank, this configuration permitting at the same time to maintain a safe distance between the wall and the end of the platform and the passage of a welding machine for the strips of the covering. Thus, as shown in FIG. 3, in a first step, the platforms are constituted by a fixed portion 10 and a telescopic portion formed of two removable floors 11, 12 supported by telescopic arms. This platform comprises moreover on the portion fixed to the strut 3, an overhanging aligning portion 13. The installation of two insulations and of the covering at a platform level takes place according to the schematic views and according to the order of the schematic views 3A–3F. In view 3A, the flooring constituted by two modular elements 11, 12 of different dimensions is shown. In step 3B, one of the modular elements, namely the element 11 which is larger, is retained while the element 12 is removed and placed on the overhanging aligning portion 13. Parallel to this modification of the flooring, insulation 14 which constitutes the first insulation layer is placed on the wall of the tank. In step 3C, the flooring element 11 is replaced by the flooring element 12 which is smaller, so as to leave a larger space between the insulating layer and the end of the platform so as to be able to apply a covering to the insulating layer and to weld this latter by means of a welding machine. In step 3D, it is necessary to provide the maximum space possible between the insulating layer and the end of the platform. To do this, the element 12 of small dimension of the platform is again replaced by the element 11 which is larger, then there is applied during this same step the second layer of insulation. When this second layer of insulation is secured, in step 3E, there is again freed, between the second layer of insulation and the end of the platform, a large space so as to permit applying the covering and to weld this latter by means of the welding machine. When, according to step 3, the welding is completed, the emplacement of insulation is finished and the assembly of removable flooring can be disassembled. Thus, by making use of the size of the removable elements forming the telescopic flooring of the telescopic platform, it is possible to perform all the covering and welding operations with a minimum of elements while observing mandatory safety rules.

To pass from one step to another, which is to say from step 3A to step 3B, from step 3B to step 3C, etc, the adjustment of the telescopic arms supporting the removable flooring forming the telescopic platform is effected with a connection member 15 fixed to the ends of said arms. This connection member is actuated by the operator who pulls or pushes this connection member with a hook affixed to the latter. This connection member 15, having the form of a plinth, serves also as an abutment so as to avoid any untimely falling of objects. To enable the operator quickly to adjust the length of the arms, indexing means are provided on each arm, so as to permit the operator rapidly to identify the stop positions which are predefined. In these stop positions, locking means are triggered so as to immobilize the assembly. These locking means are constituted by indexing means or by supplemental means permitting, in case of tilting, to avoid any reentry of the telescopic members. Once these telescopic arms are immobilized in one position, the required flooring formed of elements 11 and 12 in FIG. 3 is emplaced. It will be noted that all these manipulations are effected very rapidly and with complete safety by a single operator. It is to be noted that generally there will also be provided supplemental telescopic elements terminating in a bearing plate. These elements are at one end secured to the structure and come by means of their plate, at the other end, into bearing relation on the wall of the tank under construction, so as to avoid any relative movement of the scaffolding in case of tilting.

Figure 2:
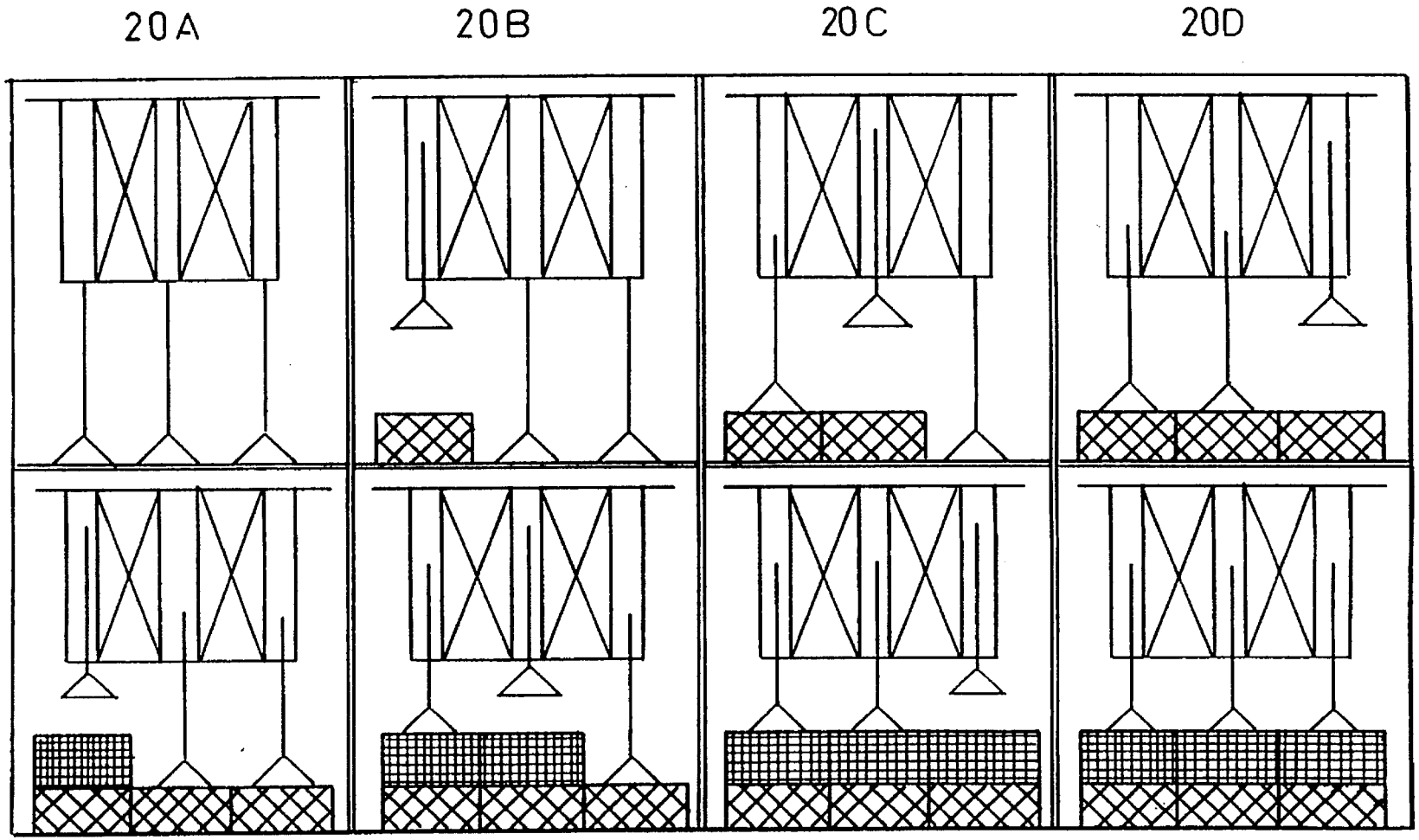
FIG. 2 is a simplified schematic view of the lines of post feet of the struts of the load bearing framework of the scaffolding of FIG. 1.

Another peculiarity of this scaffolding resides in its footing which permits working on the bottom of the hollow element, even in the presence of the scaffolding. Thus, according to FIG. 2, the scaffolding is constituted at the level of each strut by three lines of feet 9*a*, 9*b* and 9*c* adapted to be adjusted in height. Obviously, each line of feet can be constituted by several tens of feet. Thus, as shown in FIG. 2, at the outset, the three lines of post feet of each strut rest on the ground. When it appears necessary to work at the bottom of the tank or the hollow element, one of these lines of post feet constituted by post feet that are adjustable in height is raised so as to permit working below this line, as shown in FIG. 2, reference 20*b*. This raising of the post feet can moreover take place in a symmetrical manner at the level of each of the struts 3 of the load bearing framework. Then, as shown in FIG. 2 at reference 20*c*, the first line of post feet comes to bear against the ground on the layer of insulation which has been added, while the second line of post feet is raised, and so on.

Figure 4:
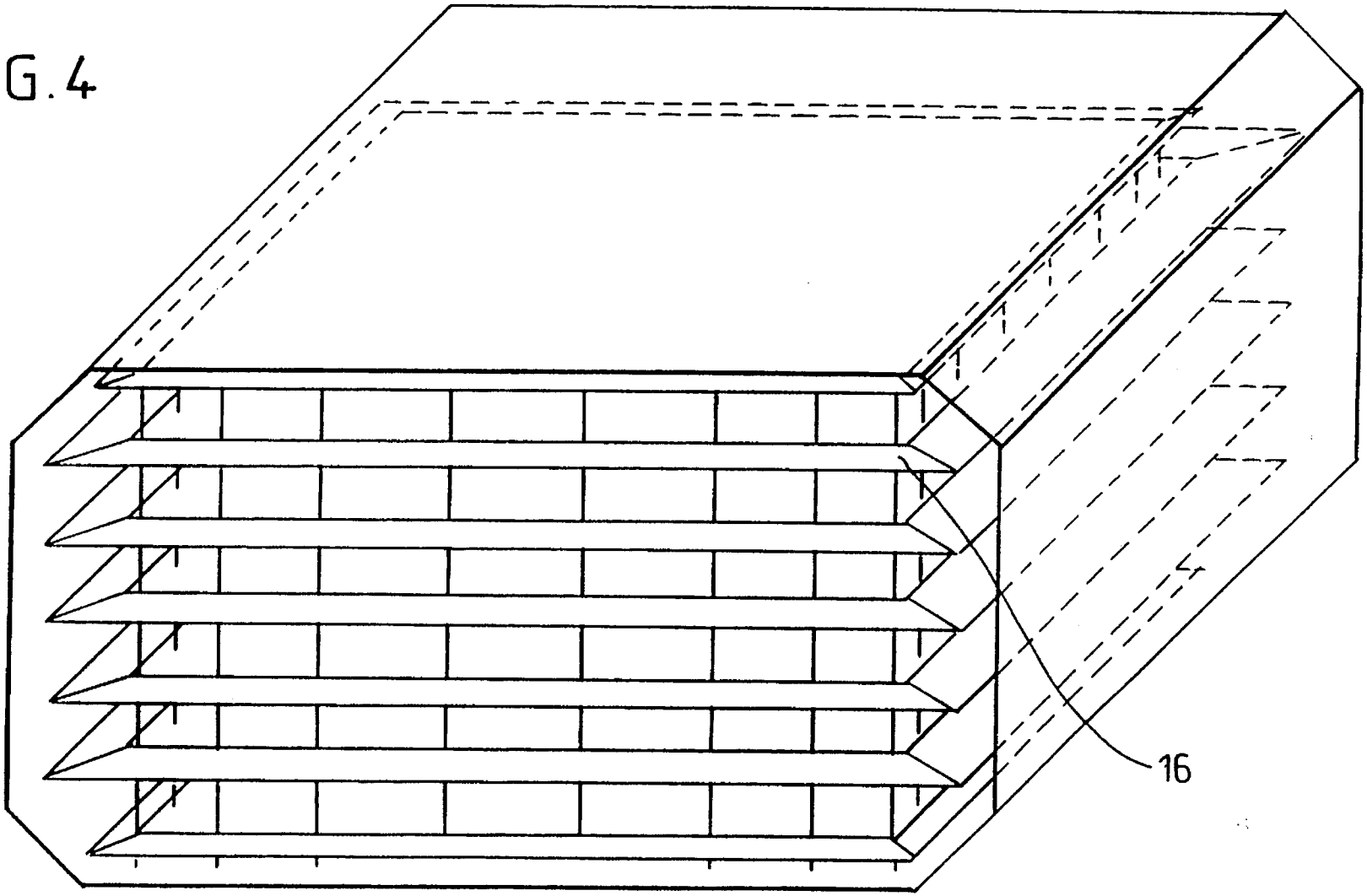
FIG. 4 is a perspective view of the scaffolding of FIGS. 1 to 3.

Thanks to the dimensions of the soles of the post feet, the contact pressure with the bottom of the tank or the hollow element is limited and there is thus avoided any degradation of the surface of the bottom of the hollow element. Such a configuration is possible only by the assembly of the configuration of scaffolding which permits freeing 70% of the bottom of the hollow element. To be able also to work simultaneously on transverse partitions of a hollow element, whether it be a tank or any other element, it is necessary to connect the struts of the load bearing framework by-a peripheral platform, which can be telescopic or not, as shown in FIG. 4. Thus, in the case of tanks adapted for the transport of methane, the transverse partitions, called COFFERDAMs, are worked on thanks to a peripheral platform designated by 16 in FIG. 4 which connects two struts of the load bearing framework.

I claim:

1. Scaffolding for working within hollow elements (1) of large dimensions, comprising a load bearing structure comprising two trusses (3) spaced apart and interconnected by at least two cross members (4, 5) forming flooring and rigidifying said scaffolding, modular platforms (6) mounted at variable heights in cantilever fashion on the external surface of said trusses (3) and access means (7) to said platforms disposed in or adjacent the trusses (3), and ground-engaging members consisting of plural rows of post feet connected to each of said trusses, individual rows of said post feet being independently adjustable in height so as to permit the temporary raising of at least one row of said post feet per truss, for engaging different levels of a lowermost surface within said hollow element.

2. Scaffolding according to claim 1, characterized in that the modular platforms (6) have at their end opposite to that secured to the trusses (3) a telescopic portion (8).

3. Scaffolding according to claim 2, characterized in that said telescopic portion (8) is formed by at least two telescopic arms supporting a removable flooring and whose ends are interconnected by a connection member (15) on which the operator acts to vary the length of said arms.

4. Scaffolding according to claim 3, characterized in that the connection member (15) constitutes also a plinth preventing any untimely falling of objects.

5. Scaffolding according to claim 3, characterized in that said at least two telescopic arms are provided with indexing means which permit locking said at least two telescopic arms into predetermined lengths.

* * * * *